US007222687B2

(12) United States Patent
Smith et al.

(10) Patent No.: US 7,222,687 B2
(45) Date of Patent: May 29, 2007

(54) HOOD FOR OFF ROAD WORK VEHICLE

(75) Inventors: Richard Jon Smith, Dubuque, IA (US); William Bradley Reynolds, Platteville, WI (US)

(73) Assignee: Deere & Company, Moline, IL (US)

( * ) Notice: Subject to any disclaimer, the term of this patent is extended or adjusted under 35 U.S.C. 154(b) by 665 days.

(21) Appl. No.: 10/457,023

(22) Filed: Jun. 6, 2003

(65) Prior Publication Data

US 2004/0244229 A1 Dec. 9, 2004

(51) Int. Cl.
*B62D 25/10* (2006.01)
*B60R 21/34* (2006.01)

(52) U.S. Cl. ..... 180/69.21

(58) Field of Classification Search ..... 296/190.11, 296/146.11, 146.2, 146.9, 148, 201, 202; 180/69.2, 69.21, 69.22, 69.23
See application file for complete search history.

(56) References Cited

U.S. PATENT DOCUMENTS 3,802,530 A * 4/1974 Purcell et al. ..... 180/89.12
5,115,878 A * 5/1992 Hayata ..... 180/69.21
5,125,716 A 6/1992 Smith et al.
5,273,606 A 12/1993 Greve et al.
5,535,841 A * 7/1996 Cobes et al. ..... 180/69.2
5,634,525 A 6/1997 Templeton et al.
5,833,024 A * 11/1998 Kaneko ..... 180/69.2
5,964,490 A 10/1999 Schroeder et al.
6,247,746 B1 * 6/2001 Brush ..... 296/190.11
6,374,936 B1 4/2002 Smith
6,398,286 B1 * 6/2002 Devin et al. ..... 296/76
6,401,851 B1 6/2002 Keen
6,460,644 B1 10/2002 Smith et al.

* cited by examiner

*Primary Examiner*—Robert E Pezzuto
(74) *Attorney, Agent, or Firm*—The Law Office of Randall T. Erickson, P.C.

(57) ABSTRACT

A hood for an off road work vehicle includes a thermoformed polymer outer top panel having a smooth outer surface, a thermoformed inner panel, the inner panel having laterally extending corrugations, and a pattern of adhesive arranged between the inner and outer top panels. The inner and outer top panels are secured together by the pattern of adhesive, the pattern of adhesive comprising non-linear longitudinally extending regions spaced apart and straddling a longitudinal centerline of the inner top panel. The non-linear regions can be undulating or zigzag regions.

23 Claims, 9 Drawing Sheets

HOOD FOR OFF ROAD WORK VEHICLE

TECHNICAL FIELD OF THE INVENTION

The present invention is directed to an engine compartment hood, and method of assembly thereof, for an off road work vehicle.

BACKGROUND OF THE INVENTION

Backhoe loaders are common off road work vehicles. These vehicles are provided with a front mounted loader and a rear mounted backhoe. The lift arms of the loader are pivotally mounted to a mast extending upwardly from the supporting structure of the vehicle. A hood covering an internal combustion engine is located in front of the mast. The hood typically comprises a structurally reinforced, sheet metal top panel. To service the engine, the hood is tilted to an open position.

The top wall of a hood for a backhoe loader must be impact and dent resistant. It is not uncommon for the top panel to be impacted by a rock or other debris. The present inventors have recognized that it would be desirable to provide a top wall for a hood that was impact and dent resistant while being cost effectively manufactured. The present inventors have recognized that it would be desirable to provide such a top wall for the hood that maintains a smooth aesthetically pleasing outer contour, even during extreme temperatures.

SUMMARY OF THE INVENTION

The invention provides a hood for an off road work vehicle, and a method of assembling the hood. The hood is preferably applied to a backhoe loader. According to one aspect of the invention, a hood for an off road vehicle includes a top wall that comprises: an outer panel and an inner panel secured to the outer panel, forming a substantially enclosed shell. Preferably, one or both the inner and outer panels are composed of thermoformable polymer.

The outer and inner panels are configured to form a space between the outer and inner panels when assembled, the space having an open outlet and an open inlet, the space arranged to channel air from outside the hood to inside the hood.

The inner panel can comprise a plurality of laterally extending corrugations, configured to add stiffness to the hood, particularly the top wall of the hood. The outer and inner panels are adhesively secured together around a substantial portion of a perimeter of at least one of the outer and inner panels by a substantially continuous pattern of adhesive having some regions applied in a non-linear pattern, such as a zigzag or otherwise undulating form, extending longitudinally.

Preferably, the inner and outer panels are composed of GE Noryl GTX PPE/PA resin, and the adhesive is composed of Essex Betaseal U-216 two-compound urethane.

The regions are applied in an undulating form correspond in distance, measured between peaks of the undulating form, to a distance between corrugations of the plurality of corrugations.

The hood can include sidewalls fastened to the inner top panel and having a dominant outer surface oriented substantially vertically.

The inner panel can comprise a plurality of protrusions, such as dimples, extending toward the outer panel, the dimples arranged to maintain a clearance between the inner and outer panels around the dimples. The clearance between the inner and outer panels provided by the protrusions can be used to regulate a thickness of the adhesive that is applied between the inner and outer panels.

The invention provides a method of forming a hood structure for an off road work vehicle, comprising the steps of: thermoforming a plastic inner panel having raised formations thereon, thermoforming an outer panel having a smooth outer surface and a contoured edge region, applying adhesive in a pattern between the inner and outer panels, and holding the inner and outer panels together until the adhesive has adequately set.

The step of applying adhesive is further characterized in that the adhesive is applied between the inner and outer panels longitudinally in a non-linear pattern along lateral edge regions of the inner panel. The non-linear pattern can comprise an undulating or zigzag pattern.

The invention provides a top wall for a hood that is impact and dent resistant. The invention provides a top wall for a hood that is cost effectively manufactured. The invention provides a top wall for a hood that maintains a smooth aesthetically-pleasing outer contour, even during extreme temperatures.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
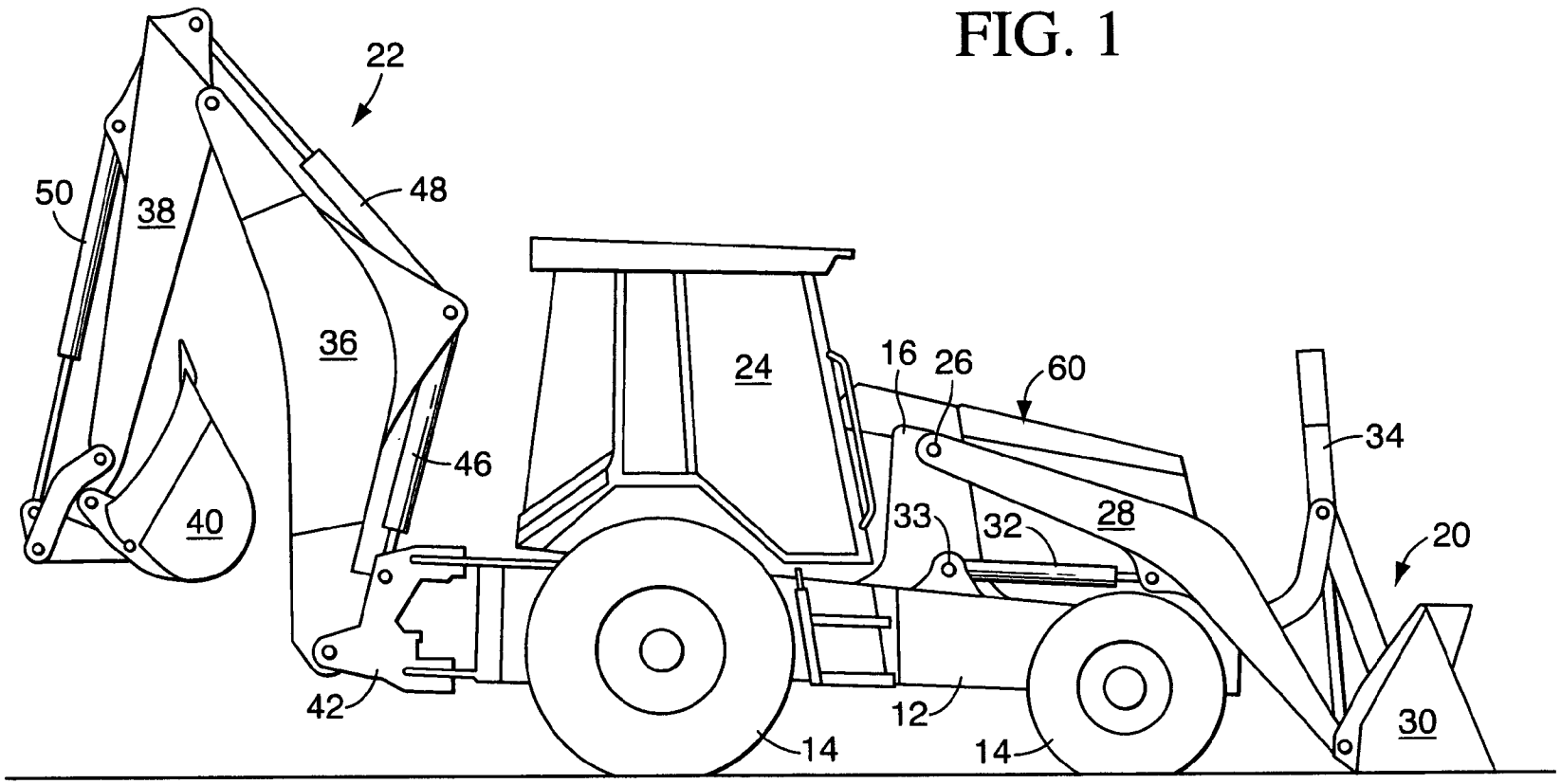
FIG. 1 is a diagrammatic elevational view of an off road work vehicle incorporating the hood of the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

A work vehicle 10 is illustrated in FIG. 1 in the form of a backhoe loader. Such a work vehicle is described for example in U.S. Pat. Nos. 6,460,644 and 5,125,716 both herein incorporated by reference. The work vehicle 10 is provided with a supporting structure 12 and ground engaging means 14 comprising wheels, which support and propel the supporting structure 12. Although the ground engaging means 14 on the illustrated embodiment are wheels, the present invention could also be used on tracked work vehicles having steel or rubber tracks. The supporting structure 12 is provided with a vertically extending mast 16. A first work implement 20 comprising a loader is operatively mounted to the mast 16 and the supporting structure 12. A second work implement 22 comprising a backhoe is mounted to the back 18 of the supporting structure 12. The operation of the work vehicle 10 and the operation of the first and second work implements 20 and 22 are controlled from the operator's cab 24.

The loader 20 comprises lift arms 28 and a bucket 30. The lift arms 28 are pivotally mounted to the mast 16 to pivots 26. The lift arms 28 are provided with lift arm hydraulic cylinders 32 for lifting arms 28 relative to supporting structure 12. The lift arm cylinders 32 are pivotally coupled to the supporting structure 12 at pivots 33. The bucket 30 is pivotally mounted to the end of the lift arms 28. The bucket 30 is provided with a bucket-tilt hydraulic cylinder 34 for tilting the bucket 30 relative to the lift arms 28.

An internal combustion engine, not shown, powers the work vehicle. The internal combustion engine is mounted to the front of the supporting structure 12.

Figure 2:
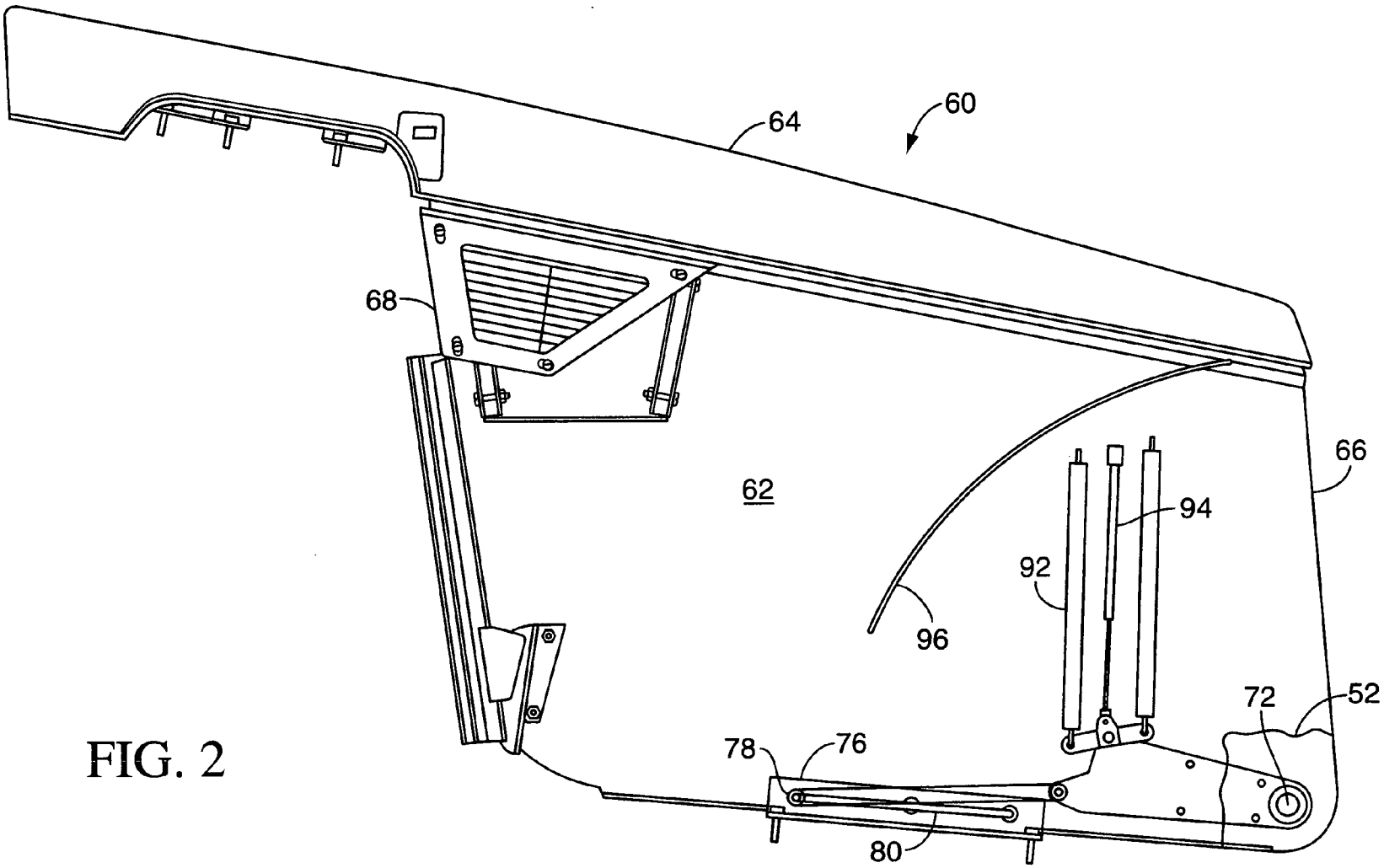
FIG. 2 is a diagrammatic longitudinal sectional view of the hood of the off road work vehicle shown in FIG. 1.

As shown in FIG. 2, the front of the supporting structure 12 is also provided with upwardly extending support flanges 52, shown in fragmentary fashion. The radiator and associated grille for the engine are mounted to the support flanges 52.

The internal combustion engine is housed by hood 60. The hood comprises two sidewalls 62 and a top wall 64 joining the sidewalls 62. In its closed position, the hood extends longitudinally between the support flanges 52 and the mast 16, so that the front edge 66 of the hood 60 is adjacent to the upstanding support flanges 52 and the rear edge 68 of the hood is adjacent to the mast 16. The sidewalls 62 of the hood 60 are mounted to pivot brackets 70. The pivot brackets 70 are pivotally mounted to the front of the supporting structure 12 at pivots 72. Pivots 72 adjoin the support flanges and define a pivot axis that passes through the support flanges 52.

The interior surface of each sidewall 62 is provided with an integral, arcuate guide 96. These guides 96 contact the sidewalls of the grille support flanges 52 to guide pivotal movement of the hood 60. The front of each arcuate guide 96 is provided with a cylindrical nylon button, not shown, which engages the sidewall of the grille support flanges 52 when the hood 60 is in its closed position. One or more hydraulic cylinders 94 and counterbalance springs 92 are operatively connected between the support flanges 52 and the pivot brackets 70 to control opening and closing of the hood. Mechanisms which support opening and closing of the hood are described in U.S. Pat. No. 6,460,644, herein incorporated by reference.

Figure 3:
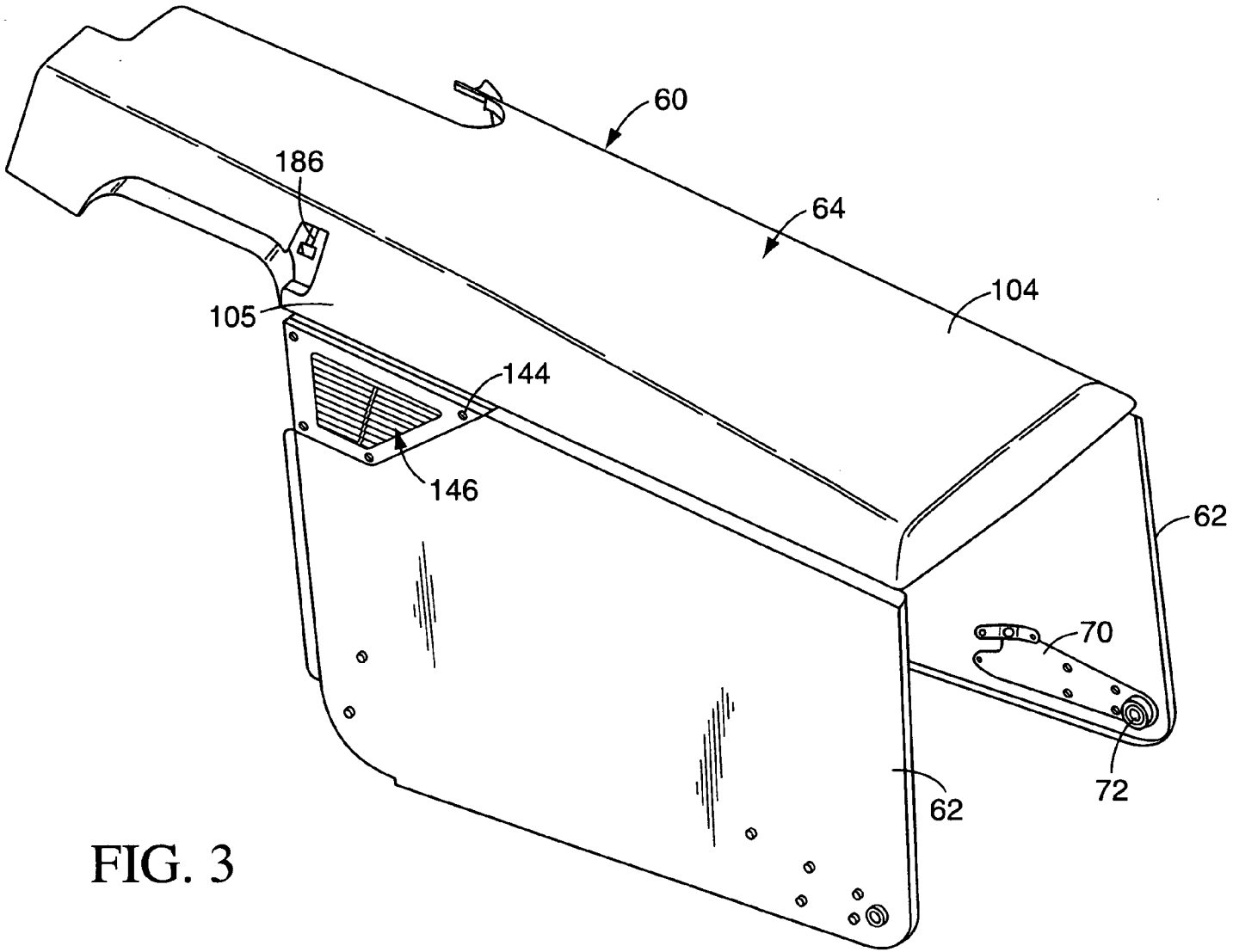
FIG. 3 is a front top perspective view of the hood shown in FIG. 2, separate from the work vehicle.
Figure 4:
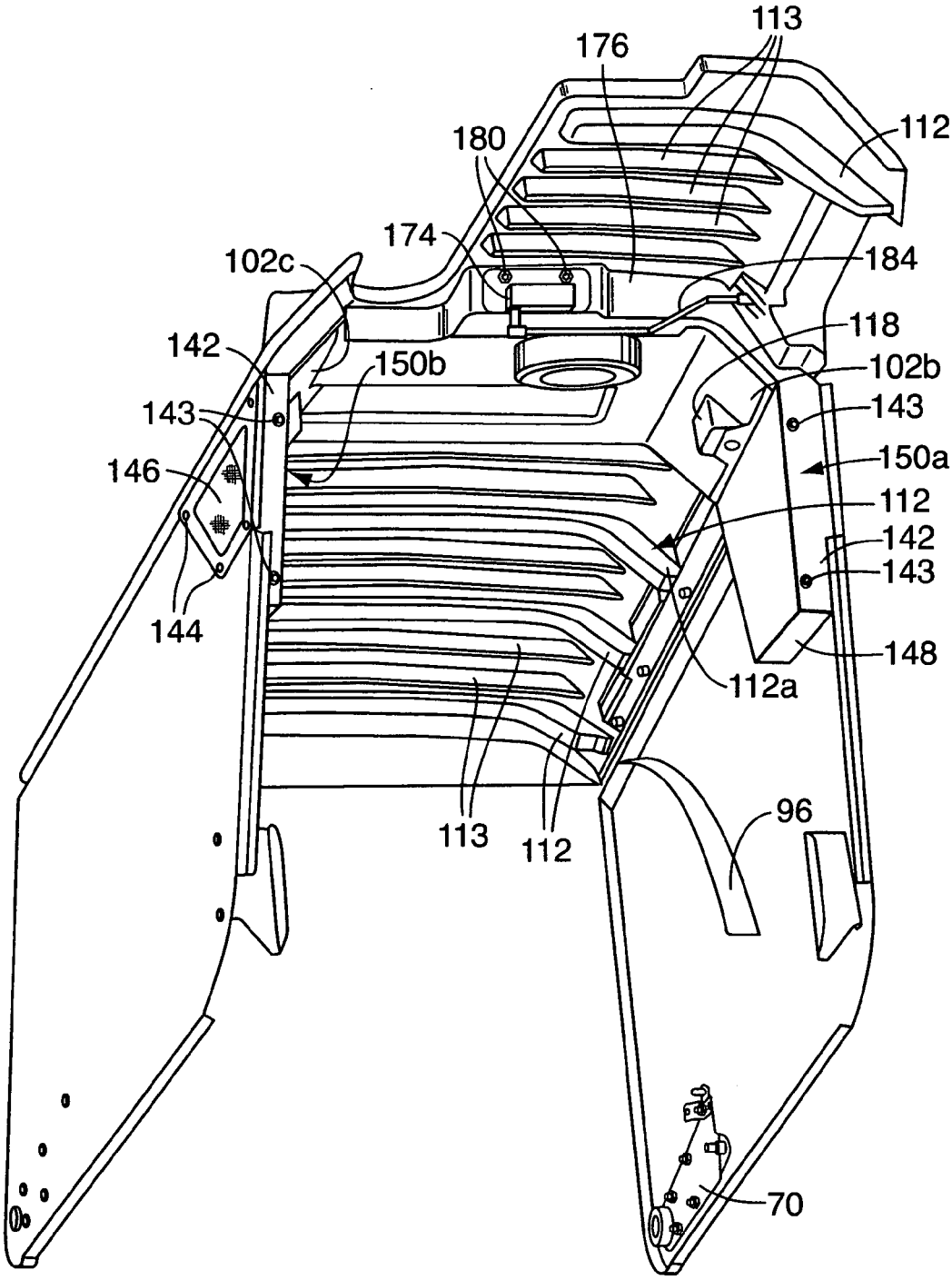
FIG. 4 is a bottom rear perspective view of the hood shown in FIG. 3.

The present invention is particularly directed to the construction of the hood 60. FIGS. 3 and 4 illustrate the top wall 64 of the hood being fabricated of two separate pieces, an inner panel 102 and an outer panel or skin 104. The inner and outer panels 102, 104 are preferably composed of polymer, preferably composed of GE Noryl GTX PPE/PA resin, in an extrusion state for thermoforming processes. Each panel 102, 104 can have a nominal thickness of about 3/16 inch.

The outer panel 104 provides a smooth, lightweight and paintable surface 105 (FIG. 3). The inner panel 102 includes ridges and formations for accepting fasteners and for forming stiffening, latching and an engine air intake duct. In order to provide a construction that is durable, rigid, high-temperature resistant and has a low temperature impact strength, the two panels 102 and 104 are fixed together to form a shell, the shell preferably being a unified structural member.

It is important that the effects of thermal expansion be accounted for in the attachment of the outer panel with the inner panel. Since the hood is subjected to both ambient and engine temperatures simultaneously, a great temperature differential can exist through a thickness of the assembled hood top wall 64. To allow for expansion and contraction, and to improve structural rigidity of the hood, shaped ribs 112 (FIG. 4) and stiffeners 113 are provided by corrugations of the inner panel 102. The ribs have substantially squared U-shaped cross sections while the stiffeners have substantially V-shaped cross sections.

The outer skin 104 is adhesively attached to the inner panel 102 as explained below. The adhesive is preferably composed of Essex Betaseal U-216 two-compound urethane.

Figure 5:
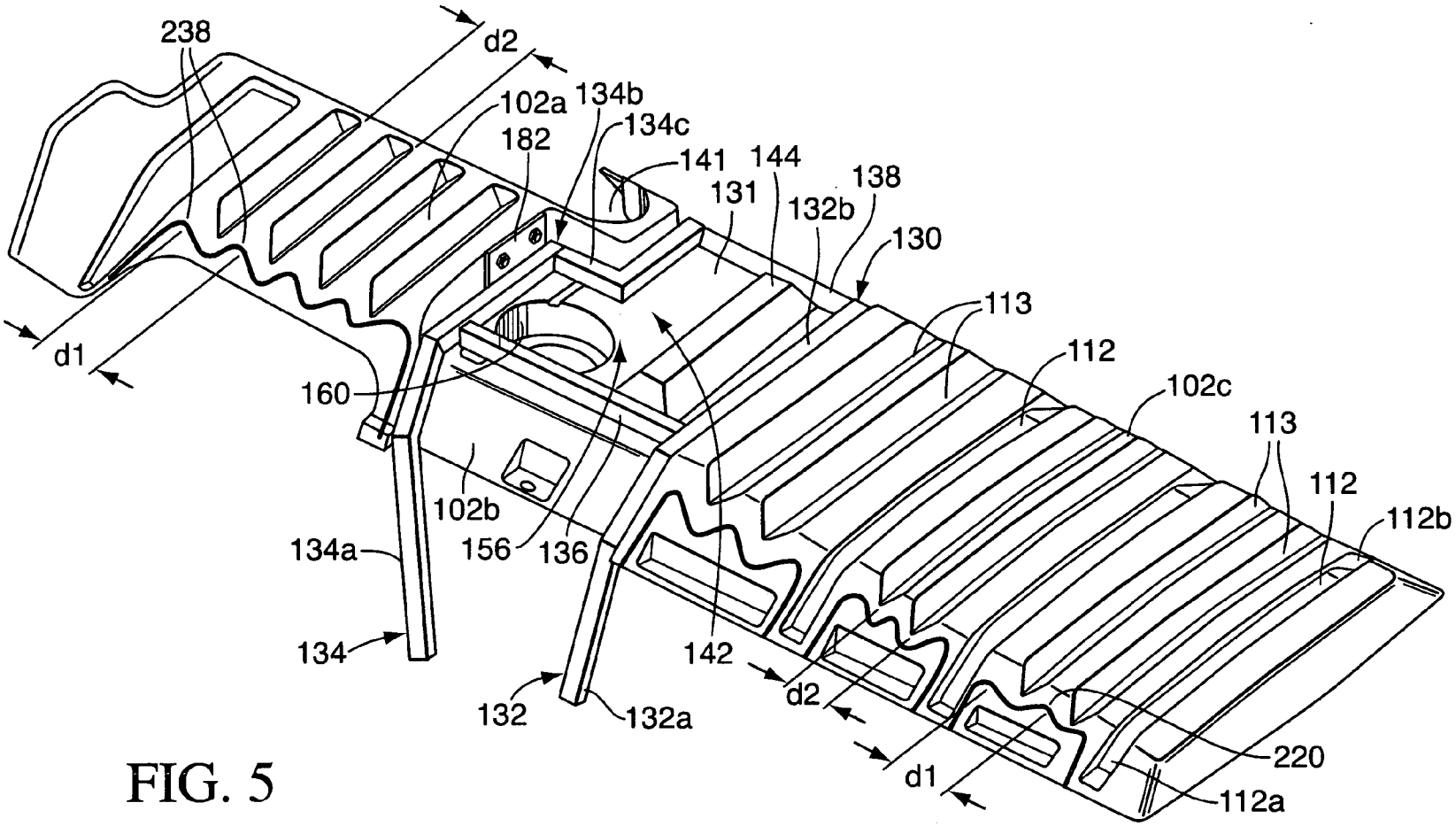
FIG. 5 is a front top perspective view of an inner panel of a top wall of the hood shown in FIG. 3, separate from the rest of the hood.

As illustrated in FIGS. 4 and 5, the inner panel 102 includes the stiffeners 113 and ribs 112. In the described embodiment, the stiffeners 113 are interspersed with the ribs 112, the ribs 112 and stiffeners 113 being spaced apart along a length of the inner panel 102. The ribs extend across a lateral dimension of a top portion 102*a* of the inner panel 102 and down each side portion 102*b*, 102*c* of the inner panel. The stiffeners 113 extend across a lateral dimension of the top portion 102*a* of the inner panel 102.

Figure 6:
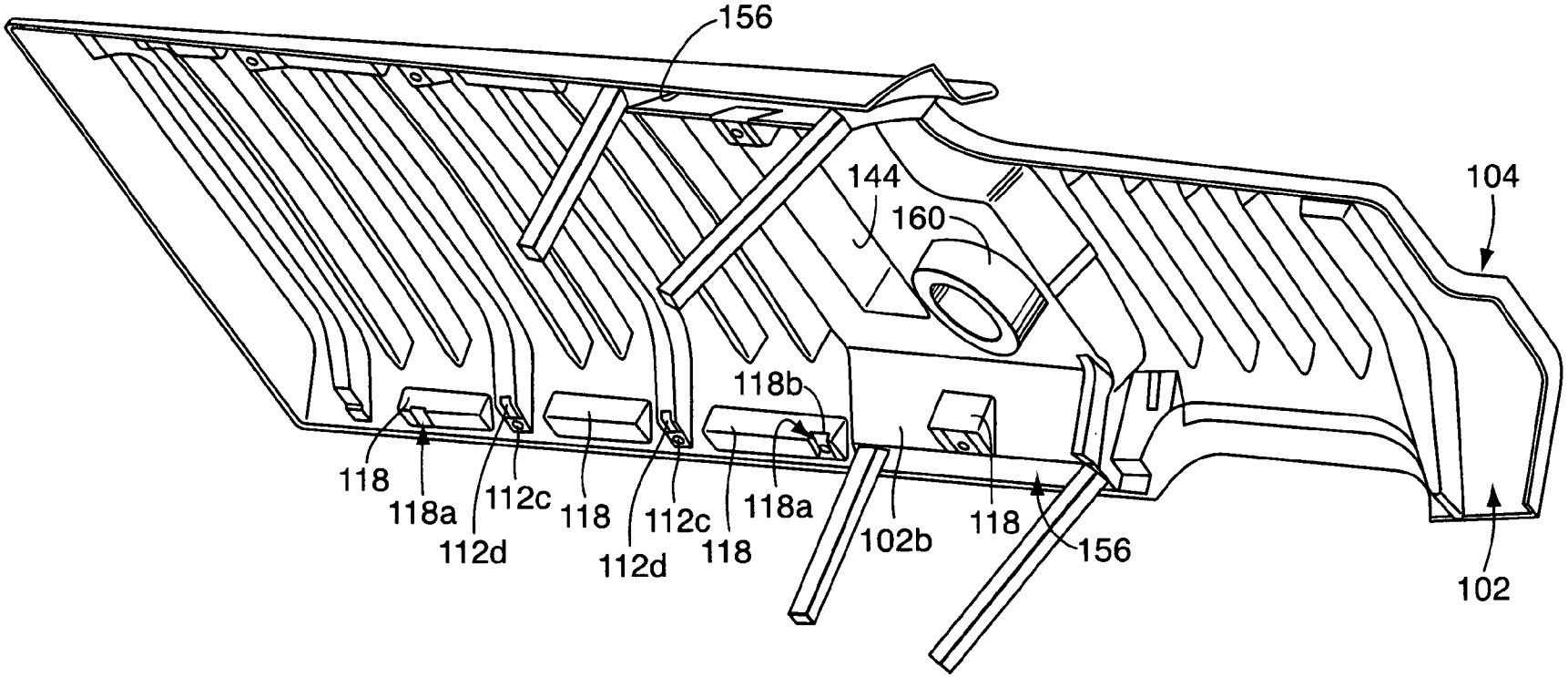
FIG. 6 is a bottom rear perspective view of the top wall of the hood shown in FIG. 5.
Figure 8:
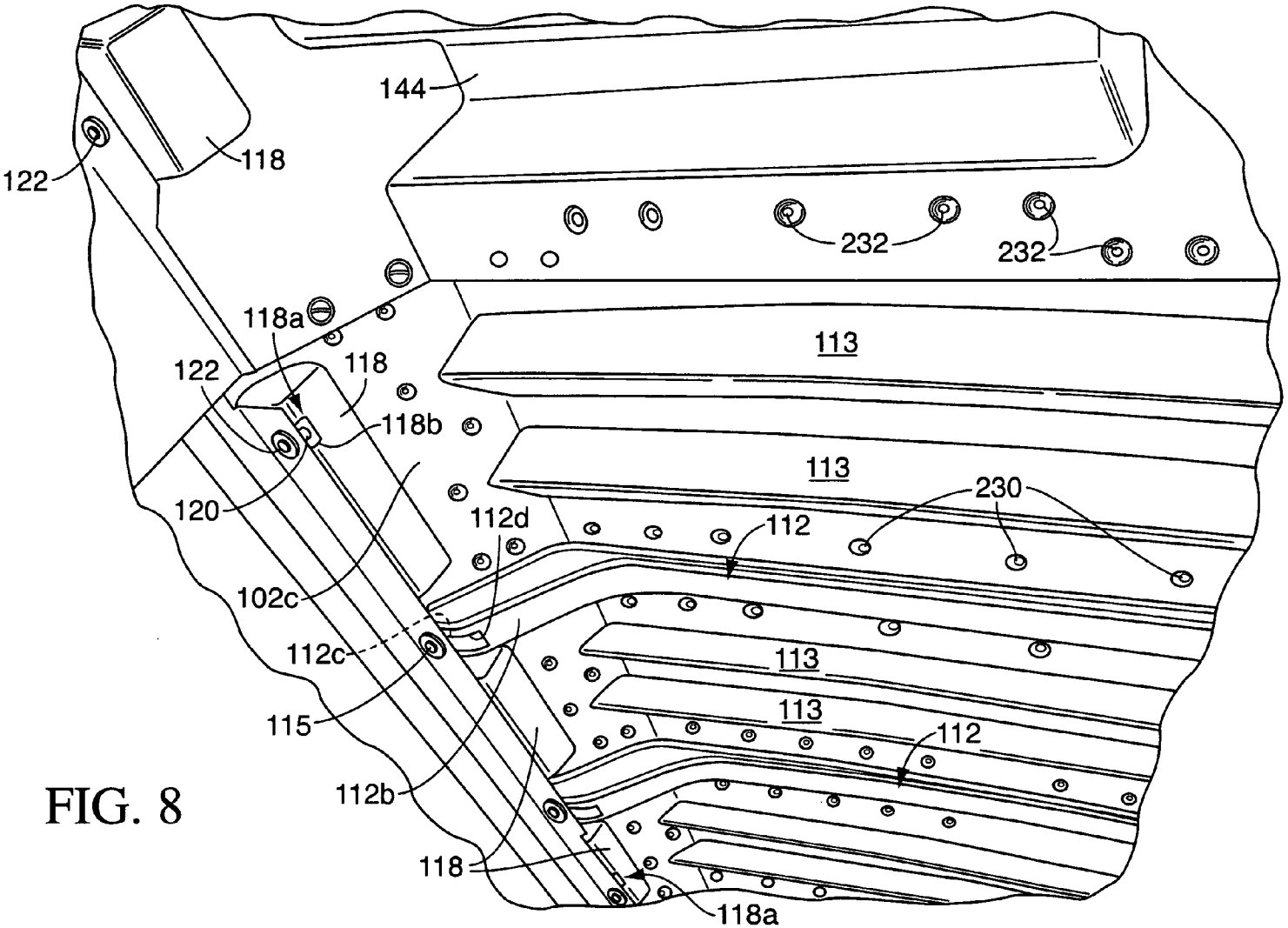
FIG. 8 is an enlarged fragmentary perspective view of an underside of the hood.

As illustrated in FIGS. 6 and 8, side portions 112*a*, 112*b* of the ribs include faster nut receptacles or seats 112*c* open facing downward. A fastener nut 114 can be fed into the receptacles 112*c* through a side passage 112*d* and thereafter be engaged by a threaded fastener 115, threaded in an upward direction through a hole (not shown) in the seat 112*c*.

Step offs or stepped bosses 118 are also provided spaced apart along the side portions 102*b*, 102*c* of the inner panel 102. The bosses 118 can also include faster nut receptacles or seats 118*a* open facing downward. A fastener nut 120 can be fed into the receptacles 118*a* through a side passage 118*b* and thereafter receive a threaded fastener 122 threaded in an upward direction through a hole (not shown) in the seat 118*a*.

The hood sidewalls 62 are fastened to the hood by the fasteners 115, 122 that engage the fastener nuts 114, 120 along the side portions 102*b*, 102*c*. The holes in the seats 112*c*, 118*a* are elongated or made oval in the longitudinal direction and the fasteners are permitted to slide longitudinally within the holes to accommodate differential thermal expansion between the top wall 64 and the sidewalls 62 of the hood.

As illustrated in FIGS. 5 and 6, a steel frame 130 is fit onto a top side 131 of the inner panel 102 and beneath the outer panel 104. The frame 130 includes substantially vertical, inverted U-shaped bents 132, 134 having substantially vertical legs 132*a*, 134*a* and horizontal lateral legs 132*b*, 134*b*, connected together by two longitudinally-extending tie bars 136, 138. The lateral leg 134*b* of the rear most U-shaped bent 134 includes a deflected portion 134*c* to clear an exhaust pipe area 141.

As viewed in FIG. 5, the steel frame 130 fits onto a trough region 142 of the top side 131 of the inner panel 102. A raised support plateau 144 of the inner panel 102 is also located within the trough region 142. The bents 132, 134 and the tie bars 136, 138 are adhesively secured in place to the top side 131 of the inner panel 102. A linear pattern of adhesive can be used between the members of the frame 130 and the top side 131.

As shown in FIG. 4, one of two vertical, three sided partitions 142 is fastened to each of the bents 132, 134 using four fasteners 144 (two shown). The bents 132, 134 are fastened to the sidewalls 62 using four fasteners 144 over a louvered air opening 146 on the respective sidewall 62 (see the louvered air opening 146 on the sidewall 62 in FIG. 3). One of two end walls 148 closes the bottom of each of the three sided partitions 142.

The mirror image identical, three sided partition 142 and end wall 148 are fastened together and to the bents 132, 134 and the respective side wall 62 in substantially identical fashion to the right side shown, and is located on the near side wall 62 in registry with the louvered air opening 146. Each combination of the three sided partition 142, the end wall 148, the respective side wall 62 and louvered air opening 146 form a partial vertical air duct 150*a*, 150*b* on one side of the hood 60.

As illustrated in FIGS. 5 and 6, each air duct 150*a*, 150*b* communicates air upwardly into a plenum 156 formed by the trough region 142 of the inner panel 102 and the overlying outer panel 104. The plenum 156 channels air into a round duct 160 formed on the inner panel 102, which is ducted into the air inlet of the internal combustion engine (not shown). The air flows between the vertical legs 132*a*, 134*a* of the adjacent bents 132, 134 and over the horizontal tie bars 136, 138. The air flows converge from opposite directions, and flow into the round duct 160.

As illustrated in FIGS. 4 and 5, spring loaded latch element 174 is mounted onto a rearward-facing vertical wall 176 of the inner panel 102 using two fasteners 180. A backing plate 182 (FIG. 5) can be used to strengthen the mounting. A hood release linkage 184 is operatively connected to the latch element 174 and extends laterally to penetrate through the inner and outer panels 102, 104, and terminates in a hand-operated hood release lever or pull 186 (FIGS. 3). The latch element 174 is self-latching to the mast 16 or other stationary part upon closing of the hood 60, and is manually released to open the hood 60 by use of the release lever or pull 186.

Figure 7:
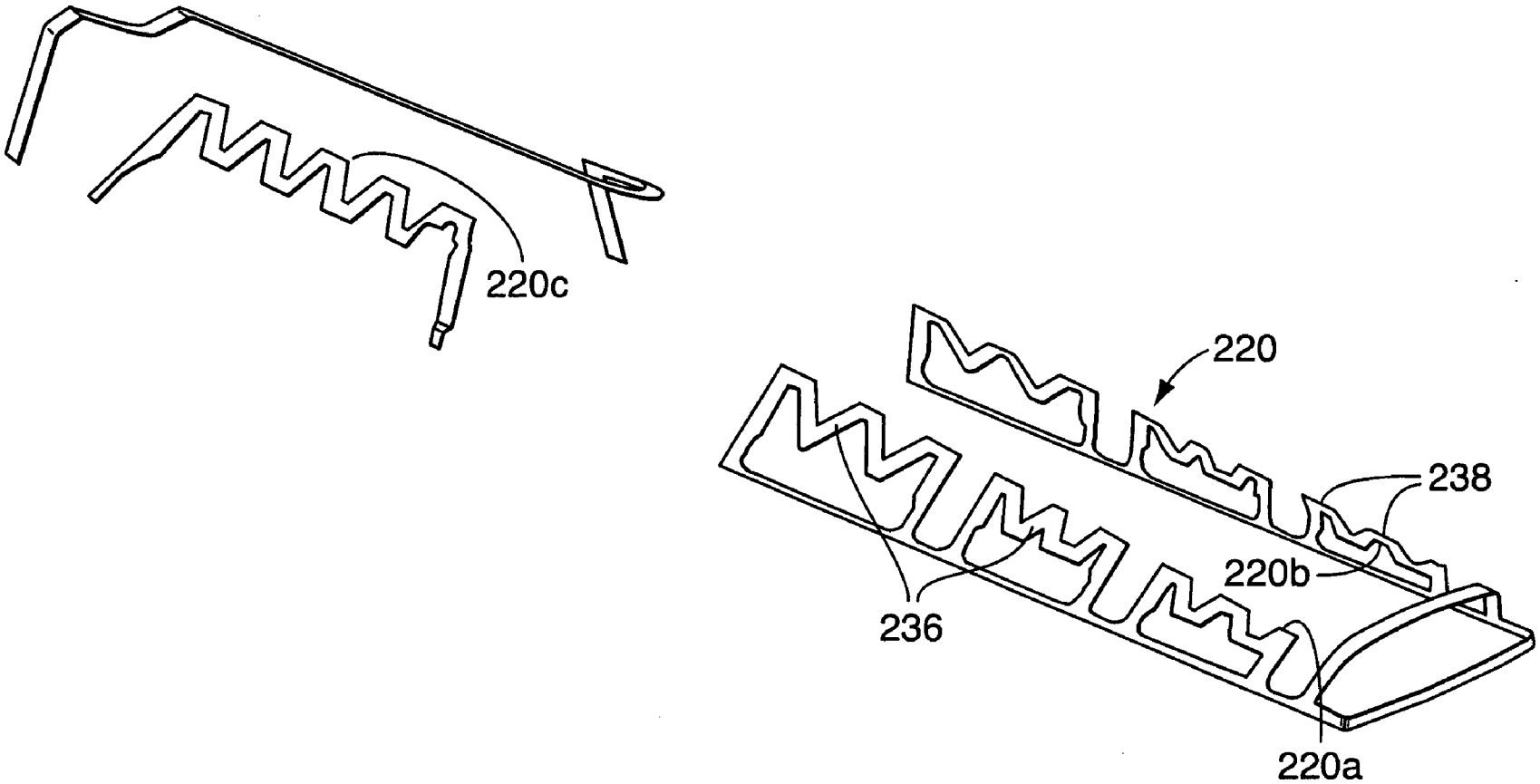
FIG. 7 is a front top perspective view of an adhesive pattern used between the inner panel and an outer skin of the top wall of the hood shown in FIG. 3.
Figure 7A:
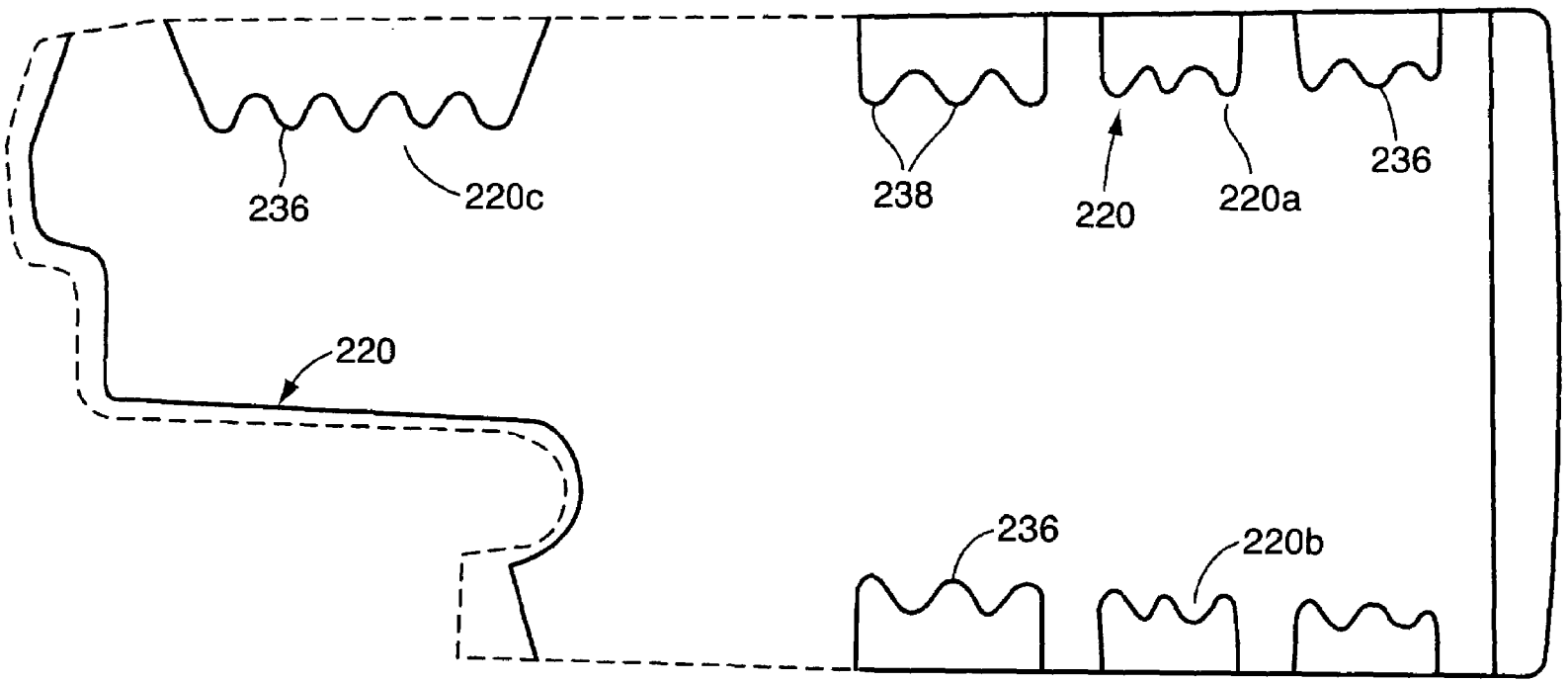
FIG. 7A is a bottom view of the adhesive pattern of FIG. 7 superimposed on an outline of the underside of the outer skin.

FIGS. 5, 7 and 7A illustrate an advantageous pattern of adhesive 220 is applied between the outer skin 104 and the inner panel 102 that facilitates the differential expansion and contraction between the inner and outer panels and prevents the differential expansion from causing a corrugated or wavy appearance on the outside surface 105 of the outer panel 104 of the hood.

The pattern of adhesive 220 is shown which will sufficiently bond the top skin 104 with the inner panel 102 but which will allow the inner panel 102 to flex longitudinally without separating from the outer skin 104 or causing a wrinkling or corrugation of the outer skin 104 that is visible from outside the hood 64. In practice, it may be more effective to apply the adhesive during assembly to the bottom surface of the upper panel 104, rather than to the upper surface of the inner panel 102. In this regard, an etching or other marking of the adhesive pattern can be applied to the inside of the outer panel 104 as a guide for the application of the adhesive to the outer panel 104.

FIG. 7 illustrates the adhesive pattern 220 in isolation from the outer skin 104 and the inner panel 102. Inner longitudinal edges 220*a*, 220*b*, and 220*c* of the pattern 220 have undulations 236 which are matched to adjacent ends of the stiffeners 113 formed in the inner top panel 102 as shown in FIG. 5. The undulations 236 can be in a substantially zigzag pattern with rounded or squared peaks 238. The longitudinal distance d1 between adjacent peaks 238 is approximately equal to the distance d2 between stiffeners that are adjacent to the respective adjacent peaks.

As illustrated in FIG. 8, in order to space the inner panel 102 from the outer panel 104, a plurality of dimples or bumps 230 are formed on the inner panel 102 that extend toward the outer panel 104. A pre-selected spacing between the inner panel 102 and the outer panel 104 serves to increase the rigidity of the shell formed by the inner and outer panels 102, 104 and also sets a uniform adhesive gap to achieve a uniform layer thickness of adhesive 220 when the panels 102, 104 are assembled. The dimples 230 have a height of about 3 mm above the surrounding surface of the inner panel 102. The dimples are spaced about 2–4 inches apart longitudinally and laterally. The inner panel 102 can also include similar dimples 232, about 3 mm tall, that are arranged below the frame 130 to set an adhesive thickness between the frame 130 and the inner panel 102.

Although the dimples 230, 232 are shown extending from the inner panel 102, a similar protrusion could be provided instead on the outer panel extending toward the inner panel and both are encompassed by the invention.

The embodiment described above provides a top wall for a hood that is impact and dent resistant. The embodiment described above provides a top wall for a hood that is cost effectively manufactured. The embodiment described above provides a top wall for a hood that maintains a smooth aesthetically-pleasing outer contour, even during extreme temperatures.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A hood for an off road work vehicle, comprising:

an outer panel having a smooth surface;

an inner panel, said inner panel having a plurality of laterally extending stiffeners;

a pattern of adhesive arranged between said inner and outer panels;

said inner and outer panels secured together by said pattern of adhesive, said pattern of adhesive comprising undulating, longitudinally-extending patterns spaced apart and straddling a longitudinal centerline of said inner panel.

2. The hood according to claim 1, comprising sidewalls fastened to said inner top panel and having a dominant outer surface oriented vertically.

3. The hood according to claim 1, wherein said undulating, longitudinally-extending patterns have a number of undulations that corresponds in number to a pattern of said plurality of stiffeners.

4. The hood according to claim 1, wherein said undulating, longitudinally extending patterns each comprise a zigzag pattern with angular peaks.

5. The hood according to claim 1, wherein said inner and outer panels are composed of PPE/PA resin, and adhesive of said pattern of adhesive is composed of two-compound urethane.

6. The hood according to claim 1, wherein said work vehicle comprises a backhoe loader and said hood comprises an air duct for entry of air into said compartment, said air duct at least partially defined by a space between said inner and outer panels.

7. A hood for an off road vehicle, comprising:

an outer panel;

an inner panel secured to said outer panel, forming a substantially enclosed shell;

one of said outer and inner panels being composed of a thermoformable polymer.

8. The hood according to claim 7, wherein both said inner and outer panels are composed of thermoformable polymer.

9. The hood according to claim 7, wherein said outer and inner panels are configured to form a space between said outer and inner panels when assembled, said space having an open outlet and an open inlet, said space arranged to channel air from outside said hood to inside said hood.

10. The hood according to claim 7, wherein said outer and inner panels are adhesively secured together substantially along a perimeter of at least one of said outer and inner panels.

11. The hood according to claim 7, wherein said inner panel comprises a plurality of laterally extending corrugations, configured to add stiffness to the hood.

12. The hood according to claim 7, wherein said inner panel comprises a plurality of dimples extending toward said outer panel, said dimples sized and arranged to maintain a clearance between said inner and outer panels around said dimples.

13. The hood according to claim 7, wherein said inner panel comprises a plurality of laterally extending corrugations configured to add stiffness to the hood, and wherein said outer and inner panels are adhesively secured together around a substantial portion of a perimeter of at least one of said outer and inner panels, by a substantially continuous pattern of adhesive having some regions applied in a zigzag form, extending longitudinally.

14. The hood according to claim 13, wherein said regions applied in a zigzag form have peaks that correspond in distance between corrugations of said plurality of corrugations.

15. A method of forming a hood structure for an off road work vehicle, comprising the steps of:

thermoforming a plastic inner panel having raised formations thereon;

thermoforming an outer panel having a smooth surface;

applying adhesive in a pattern between said inner and outer panels; and holding said inner and outer panels together until said adhesive has adequately set.

16. The method according to claim 15, wherein said step of applying adhesive is further characterized in that said adhesive is applied between said inner and outer panels longitudinally in an undulating pattern along lateral edge regions of said inner panel.

17. The method according to claim 16, wherein said undulating pattern comprises zigzag regions.

18. A hood for an off road work vehicle, comprising:

an outer panel having a smooth surface;

an inner panel;

a pattern of adhesive arranged between said inner and outer panels; and said inner and outer panels secured together by said pattern of adhesive, said pattern of adhesive comprising undulating, longitudinally-extending patterns spaced apart and straddling a longitudinal centerline of said inner panel.

19. The hood according to claim 18, wherein both said inner and outer panels are composed of thermoformable polymer.

20. The hood according to claim 18, wherein said outer and inner panels are configured to form a space between said outer and inner panels when assembled, said space having an open outlet and an open inlet, said space arranged to channel air from outside said hood to inside said hood.

21. The hood according to claim 18, wherein said inner panel comprises a plurality of laterally extending corrugations, configured to add stiffness to the hood.

22. The hood according to claim 18, wherein said inner panel comprises a plurality of dimples extending toward said outer panel, said dimples sized and arranged to maintain a clearance between said inner and outer panels around said dimples.

23. The hood according to claim 18, wherein said inner panel comprises a plurality of laterally extending corrugations configured to add stiffness to the hood, and wherein said outer and inner panels are adhesively secured together around a substantial portion of a perimeter of at least one of said outer and inner panels, by a substantially continuous pattern of adhesive having some regions applied in a zigzag form, extending longitudinally.

* * * * *